United States Patent [19]

Gubau

[11] Patent Number: 4,575,269

[45] Date of Patent: Mar. 11, 1986

[54] PORTABLE ELECTRONIC TYPEWRITER

[75] Inventor: Josè Gubau, Ivrea, Italy

[73] Assignee: Ing. C. Olivetti & C., S.p.A., Ivrea, Italy

[21] Appl. No.: 599,972

[22] Filed: Apr. 13, 1984

[30] Foreign Application Priority Data

Apr. 13, 1983 [IT] Italy ..... 67405 A/83

[51] Int. Cl.[4] ..... B41J 19/30

[52] U.S. Cl. ..... 400/322; 400/328

[58] Field of Search ..... 400/322, 328, 577

[56] References Cited

U.S. PATENT DOCUMENTS

| | | | |
|---|---|---|---|
| 2,875,882 | 3/1959 | Capellaro et al. | 400/322 |
| 3,554,347 | 1/1971 | Perkins | 400/328 |
| 3,986,091 | 10/1976 | Quiogue et al. | 400/322 X |
| 4,285,606 | 8/1981 | Giacone | 400/322 X |

FOREIGN PATENT DOCUMENTS

| | | | |
|---|---|---|---|
| 72789 | 5/1970 | German Democratic Rep. | 400/322 |
| 0776942 | 11/1980 | U.S.S.R. | 400/322 |

OTHER PUBLICATIONS

IBM Technical Disclosure Bulletin, "Escapement Control Mechanism" by Bethel et al., vol. 24, No. 8, p. 4349, 1-82.

*Primary Examiner*—Edgar S. Burr
*Assistant Examiner*—John A. Weresh
*Attorney, Agent, or Firm*—Banner, Birch, McKie & Beckett

[57] ABSTRACT

The typewriter comprises a character carrying daisy-wheel having flexible petals which is carried by a carriage that is movable transversely with respect to the platen roller. Mounted on the carriage are a motor for moving the carriage, a motor for character selection, a print hammer, a cartridge for the typing ribbon, a correction ribbon and a drive unit for advancing the typing ribbon and raising and advancing the correction ribbon. The structure of the hammer and the arrangement of the typing ribbon and the character carrying daisy-wheel are such that typing and reading of the line of print are possible without it being necessary for the typing ribbon to be raised. The carriage is displaced in the two directions from the current position to an intermediate position to the left of the desired position. The carriage is then positioned precisely by a tooth-type setting means after a undirectional displacement of the displacement motor.

20 Claims, 7 Drawing Figures

PORTABLE ELECTRONIC TYPEWRITER

BACKGROUND OF THE INVENTION

The present invention relates to an electric typewriter of the daisywheel type, in particular a portable electronic typewriter.

In typewriters and in high-speed printers of the daisywheel type, the characters are carried by the flexible 'petals' of the daisywheel. The daisywheel is rotated by a suitable motor which is controlled by the electronic control unit of the typewriter and the selected character is printed by the action of a print hammer and by means of a typing ribbon disposed in front of the point of typing. The daisywheel is then moved intermittently along the line of print by a second motor which is also controlled electronically. The speed and quality of printing are generlly very good by virtue of the low level of inertia and the degree of accuracy of the selection and transportation devices.

Portable electronic typewriters of this type do not differ greatly from the larger machines and the differences generally lie in the actuators used being of lower power, for lower speeds and lower general levels of performance. The overall cost is rather high and is not competitive with that of mechanical portable typewriters.

The object of the present invention is to provide a typewriter of the daisywheel type which, without compromise in respect of quality of printing, is of very low cost and very limited size, for use particularly in portable machines.

DESCRIPTION OF THE DRAWING

The features of the invention will be clear from the following description which is given by way of non-limiting example with reference to the acommpanying drawings, in which.

DESCRIPTION OF THE ILLUSTRATED EMBODYMENT

Figure 1:
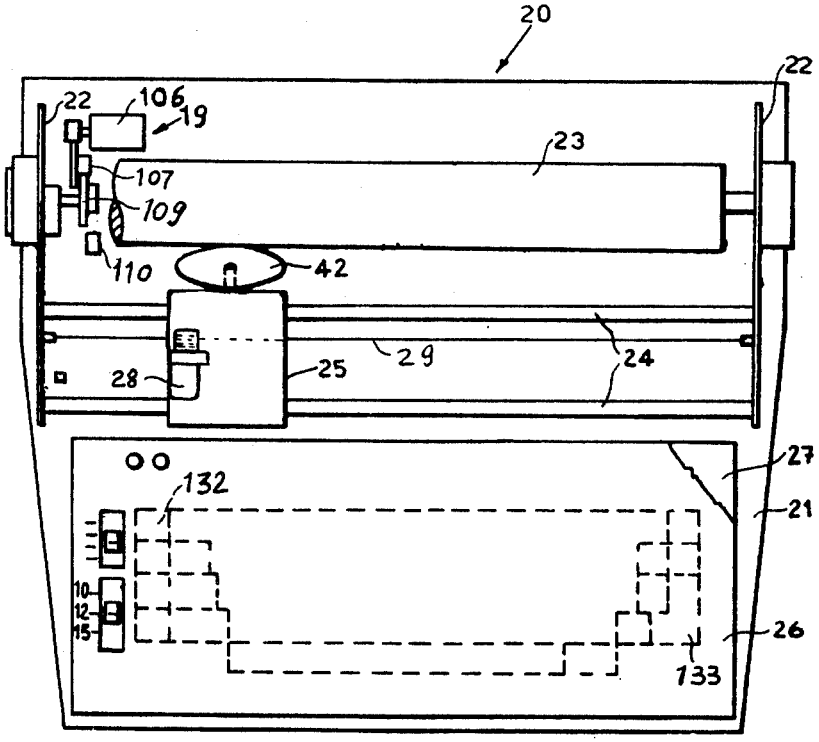
FIG. 1 is a diagrammatic plan view of a portable electronic typewriter embodying the invention.

With reference to FIG. 1, the electronic typewriter 20 comprises a base 21 on which is fixed a frame structure 22 which supports a platen roller 23, a line spacing mechanism 19 and two bars 24 which slidably guide a print unit 25. Also fixed on the base are a keyboard 26 of the contact type and a board 27 for an electronic control unit. A motor 28 which is mounted on the print unit 25 provides for the transverse movements of the unit 25 by means of a wire 29 which is partially wound around a drum 30 driven by the motor 28.

The unit 27 receives from the keyboard 26 the code of the character to be printed and the functions to be performed and provides for passing the associated commands to the print unit 25 and the line spacing mechanism 19.

Figure 3:
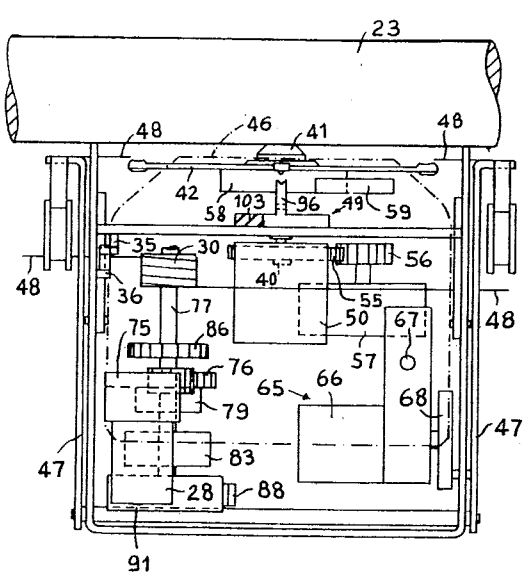
FIG. 3 is a plan view of the detail shown in FIG. 2.
Figure 2:
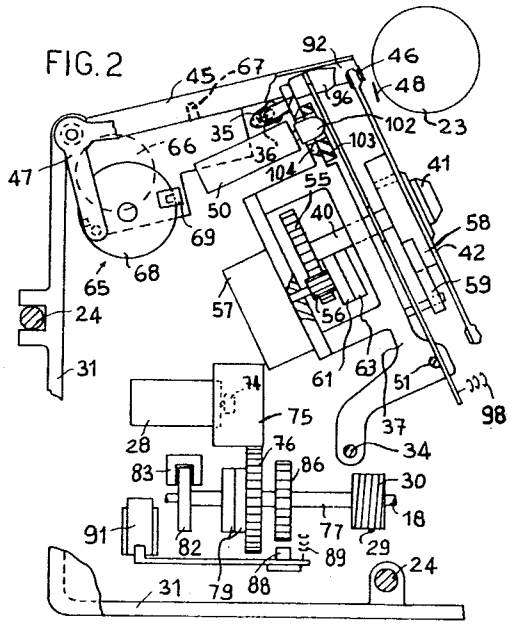
FIG. 2 is a side view of part of a detail of the machine shown in FIG. 1.
Figure 4:
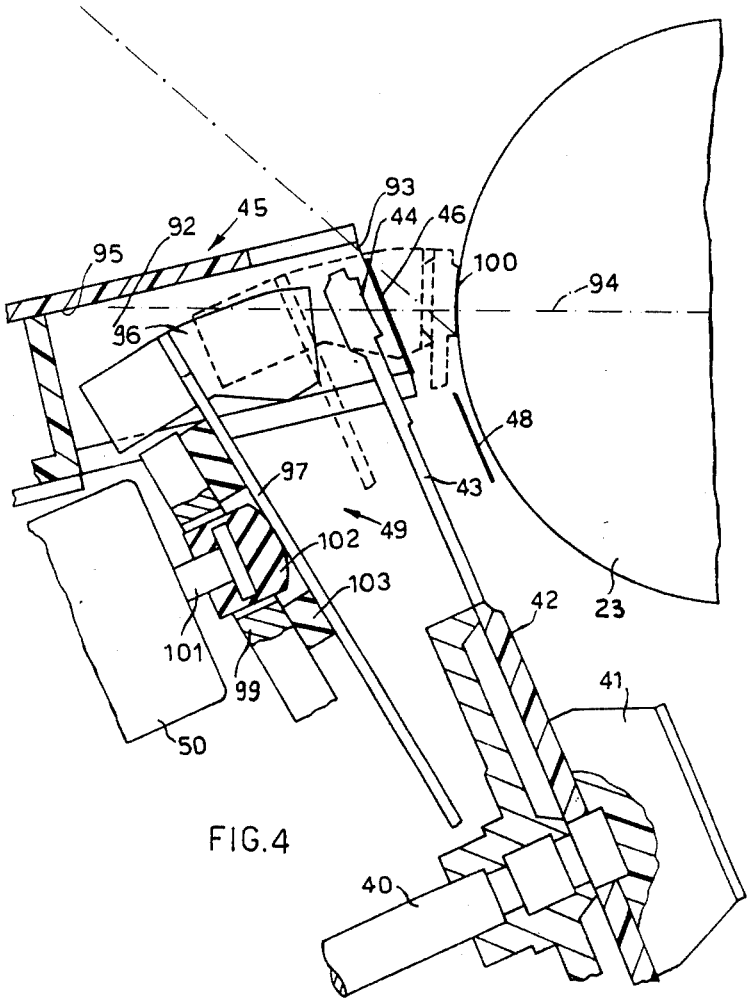
FIG. 4 is a side view on an enlarged scale of details of the structure shown in FIG. 2.

With reference to FIGS. 2, 3 and 4, the print unit 25 comprises a carriage 31 which is guided by the bars 24 and on which is a carrier 37 is pivotally mounted by means of a spindle 34 which is parallel to the platen roller 23. The carrier 37 can be locked to the carriage 31 by the action of a spring-type positioning means 35 on a pin 36.

Rotatably mounted on the carrier 37 is a drive shaft 40, to one end of which is fixed a daisywheel 42, substantially as described in the Italian patent No. 1 016 590. A cartridge 45 for a typing ribbon 46 can also be fixed on the carriage 31, while pivotally mounted on the carriage 31 is a guide frame structure 47 for a correction ribbon 48, for example as described in the published British application GB No. 2 067 472. The daisywheel 42 is provided with one hundred 'petals' 43, each of which carries a character 44, the characters 44 being printed by means of a print hammer 49 which is pivotally mounted on a spindle 51 on the carrier 37 and actuated by a solenoid 50.

For selecting the characters, fixed on the shaft 40 is a toothed wheel 55 which meshes with a pinion 56 of an electric motor 57 of the stepping type, which in turn is fixed on the carrier 37. Also fixed on the shaft 40 is a sleeve member 58 provided with a positioning recess with which a tooth 59 can co-operate, to define a zero position of the daisywheel 42. That is effected in an initialisation phase of the machine, after a preliminary movement of the carriage into a position outside its normal stroke movement, at the beginning of the line of print, in the manner described in the Italian patent application No. 67354A/83.

The pinion 56 also rotates a disc 61 against which a counterdisc 63 presses with weak frictional engagement, the counterdisc 63 in turn being free to rotate with respect to the pinion 56. The assembly forms a dissipative inertial element which is capable of damping the oscillations of the stepping motor 57 around the desired selection positions of the daisywheel 42.

Fixed on the carriage 31 is a service unit 65 comprising a motor 66, an output shaft 67 which can produce the advance movement for the typing ribbon 46, a cam 68 which is capable of lifting the guide frame structure 47 for the correction ribbon 48, a Hall detector 69 which magnetically detects two reference positions, at 180° from each other, of the cam 68. The service unit 65 selectively provides for lifting the correction ribbon in dependence on the direction of movement of the cam 68 and the motor 66, in the manner described in the published European patent application EPO 0 038 215.

For producing the movements of the carriage 31, the motor 28 which is of direct current type is provided with a pinion 74 which, by means of a reducing unit 75, transmits the movement to a gear 76. The gear 76 is connected by means of a pair of friction members 79 to a metal tube 77 which in turn is rotatable on a longitudinal shaft 78. The drum 30 and the movable part of a position transducer 81 of magnetic type are respectively fixed or keyed on the front and rear ends respectively of the tube 77. The movable part of the transducer 81 comprises a ring 82 which is subdivided into twenty sectors which are alternately magnetised at the two polarities. Two Hall detectors 83 and 84 are fixed on the carriage 23 and, with a phase displacement of 90°, detect the magnetic field of the various magnetised sectors of the ring member 82 to distinguish the direction of rotation of the tube 77.

Figure 6:
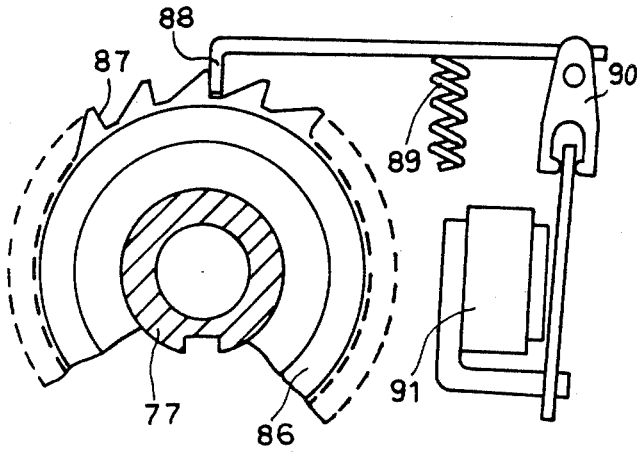
FIG. 6 is a front view of another detail of the structure shown in FIG. 2.
Figure 5:
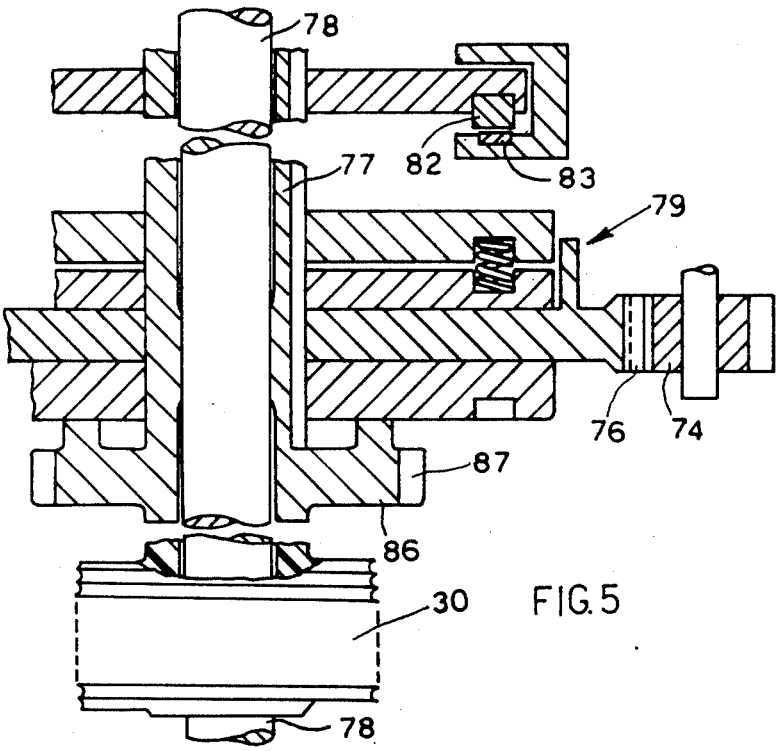
FIG. 5 is a side view of another detail of the structure shown in FIG. 2.

In a part adjacent to the pair of friction members 79, the tube 77 carries a setting disc 86 provided with twenty recesses 87 of a sawtooth configuration, each of which is capable of co-operating, by virtue of the force of the spring 89, with a setting tooth 88 carried by a pivot 90 (FIG. 6). Associated with each position of engagement of a recess 87 with the tooth 88 is a corresponding printing position of the carriage 31, along the platen roller 23. When a solenoid 91 is actuated, it provides for releasing the tooth 88 from the member 86, permitting free movement of the carriage 31.

The structure of the cartridge 45 and the hammer 49 and the arrangement of the daisywheel 42 with respect to the platen roller 23 are such as to render the entire line of printing 100 visible, without the need for any movement of the typing ribbon or the carriage. With reference to the diagrammatic view shown in FIG. 4, the typewriter is supported on a horizontal surface and the angle of visibility of the lines of print is about 40° with respect to a horizontal plane. The diameter of the daisywheel 42 is about 80 mm and it is disposed with its plane of rotary movement, inclined at about 24°, forwardly of the machine, relative to a vertical plane. The upper edge of the character carrying petals 43 is disposed at about 2.5 mm from a horizontal plane 94 passing through the axis of the platen roller 23 and the axis of the line of print 100, which is assumed to be of a maximum height of about 6 mm, is 0.8 mm approximately higher than the plane 94. The distance of the central part of the character 44 from the roller 23 is about 6 mm.

The cartridge 45 is of substantially parallelepipedic shape and is provided with two short side arm portions 92. Each arm portion has a slot for the ribbon to pass therethrough and a shoulder 93 which guides a portion of ribbon 46 on the outside of the cartridge between the platen roller 23 and the upper sector of the daisywheel 42. The guide shoulders 93 are inclined at about 170° with respect to the plane of the top 93 of the cartridge 45. When the cartridge is fitted on the machine, the top is inclined at about 14° forwardly with respect to the plane 94 and the upper edge of the portion of ribbon which extends in front of the platen roller is spaced at about 6 mm from the roller. With that structure, the upper edge of the ribbon permits the various characters in the line of print, including the characters which have downward strokes and the underlining marks, to be easily recognised.

The hammer 49 is of ballistic type and comprises a head 96 which is fixed to a carrier arm 97 which is pivoted on the spindle 51, being pulled forwardly by a spring 98 and stopped by a bar 99. The striker is housed in a space 95 provided between the arm portions 92 and is protected by the top of the cartridge. An actuator 101 of the solenoid 50 acts on the upper part of the carrier arm 97, the actuator 101 being provided with a noise-suppressing buffer 102. Fixed to the front part of the carrier arm 97 is a platelet 103 of magnetic rubber which adheres to the bar 99 in the rest position of the hammer. The member 103 accumulates energy during the phase which preceeds the 'throw' of the hammer and dampens the rebound phenomena as between the carrier 97 and the bar 99 in the return phase, after the strike action. During the strike action, the hammer head 96 follows a substantially rising path of movement and the striking portion thereof is parallel to the wedge-shaped portion of the petal 43 only at the moment of impact of the character 44 against the platen roller 23.

The line spacing mchanism 19 (see FIG. 1) is substantially of the type described in the published European application 0 038 216. It comprises a motor 106 which, by means of an eccentric 107, actuates a ratchet mechanism 108, engaged with a gear 109 on the platen roller 23. A Hall detector 110 detects a magnetised zero position of the eccentric 107. An elementary line spacing movement of the roller 23 corresponds to one revolution of the eccentric.

The three direct current motors 28, 66 and 106 are advantageously of low cost and identical to each other.

Figure 7:
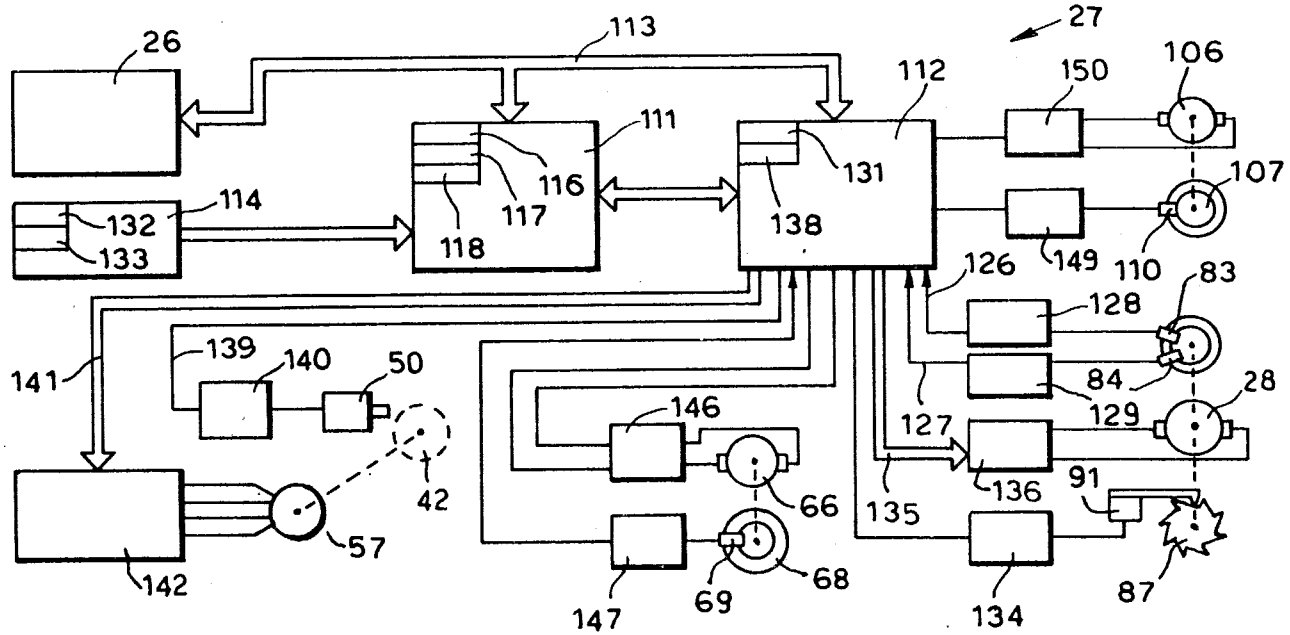
FIG. 7 is an electrical block circuit diagram of the typewriter.

Referring now to FIG. 7, the electronic unit 27 comprises two microprocessors, namely a master microprocessor 111 and a slave microprocessor 112, which interface with the keyboard by means of lines 113.

By means of a series of service keys 114, the microprocessor 111 provides for the forward and rearward movements of the carriage 31 and also provides for storage, in an editing memory 116, of the print format and the spacing pitch and, in a word memory 117, the codes of the last ten characters which were keyed in, for erasing them from the paper. The microprocessor 111 further comprises a buffer 118 for storing the keyed-in data which have not been processed.

The slave microprocessor 112 receives on lines 121 the code of the key which is produced by the microprocessor 111, and, on lines 126 and 127, the signals of the detectors 83 and 84 which in turn are processed in squaring circuits 128 adn 129. The microprocessor 112 comprises a register 131 for storing the current position of the carriage 31. The content of that register is increased or reduced upon each elementary movement of the carriage 31 which is detected by a switching action on the line 126 and in accordance with the direction of movement as detected by the signal on the line 127.

The service keys 114 comprise a tabulator key 132 and a carriage return key 133. In response to actuation of one of the keys 132 or 133, the microprocessor 111 compares the code in respect of the current position of the carriage with that in respect of the desired position and computes the direction of movement and the distance in elementary steps. On the basis of those data, the microprocessor 112 supplies corresponding control signals by means of lines 135 to a pilot control circuit 136 for the motor 28.

For character selection in response to actuation of one of the keys of the keyboard 26, the slave microprocessor 112 comprises a register 138 in which the current position of the daisywheel 42 is stored. The microprocessor 111 computes the distance, in angular steps, of the character to be printed and the direction of rotation, in the shortest arcuate direction. On the basis of such data, the microprocessor 112 supplies the stepping motor with the appropriate commands by means of lines 141 and a pilot control circuit 142.

When the petal of the character to be printed is in front of the striker 96, the solenoid 50 is activated by means of a line 139 and a power circuit 140 to print the selected character. The motor 66 is also activated, by means of lines 143 and 144 and a pilot control circuit 146, for a rotary movement of one revolution in a clockwise direction of the cam 68. That is signalled by the detector 69, the signals of which reach the microprocessor 112 after squaring in a circuit 147.

A character is cancelled in a similar manner to the printing thereof, with the sole difference that, before actuation of the solenoid 50, the cam 68 is rotated through 180° in an anticlockwise direction under the control of the detector 69. That causes the frame structure 47 to be raised and the correction ribbon 48 to be advanced, in the manner described in above-mentioned application EPO 0 038 215. After the character cancellation operation, the microprocessor 111 causes a further rotary movement of 180° in an anticlockwise direction of the cam 68 and return of the frame structure 47 to the rest position.

The same microprocessor 112 controls the movements of the platen roller 23 by means of the Hall detector 110, the signals of which are squared in a circuit 149, and also provides for the commands for the motor 106 by means of a pilot control circuit 150.

The speeds imparted to the motor 28 are tabulated as control signals of the circuit 136 in dependence on the distance from the target point. Upon each switching action generated by the detector 83, a new table signal is supplied to the circuit 136.

If the direction of movement of the carriage is from left to right, the microprocessor 112 computes the distance relating to a movement as far as an elementary step to the left of the desired position. Such positioning in an intermediate position to the left of the desired point is effected even if the direction of movement of the carriage is from right to left. In the latter case, the microprocessor 112 will reverse the direction of movement of the motor 28 to move the carriage by one step to the right into the desired position.

Independently of the initial direction of movement, when the signal on the line 126 indicates that the carriage has moved into the intermediate position, to the left of the desired point, the microprocessor 112 causes deactivation of the solenoid 91 and reactivates the motor 28 for a slow rotary movement thereof in the direction in which the carriage 31 is moved to the right. That causes the wheel 87 to be stopped by the tooth 88. The occurrence of a fresh switching action in the line 126 confirms that the carriage has been positioned at about the desired position. After a predetermined period of time which is sufficient for damping of the rebound as between the tooth 88 and the wheel 87, the microprocessor 112 deactivates the motor 28 and supplies the microprocessor 111 with a signal confirming that the carriage has stopped in the desired position.

During the period of reactivation of the motor 28, the pair of friction members 29 have permitted the gear 87 to rotate slowly while the carriage has taken up by a undirectional movement any play between the tooth 88 and the gear 87 and between the other moving parts and has restored identical conditions in respect of elongation of the wire 29. This is a matter of particular advantage with respect to correcting the characters by means of re-typing the same characters, using the correction ribbon. In fact, in that case, the correction operation may be carried out only if the character is positioned for the correction operation, with a high degree of accuracy. The above-described structure makes it possible to achieve that result and permits cancellation of the character in a single cycle, even if the transducer used is very crude.

It will be apparent that various modifications may be made in the above-described description without thereby departing from the scope of the invention.

In particular, the mechanism comprising a DC motor, a pair of friction members, a coarse transducer and the couple setting disc and setting tooth operated by a suitable actuator or electromagnet may be used to replace the stepping motor to rotate the daisy wheel for the selection of the character to be printed. The daisy wheel is bi-directionally rotated in this case by the DC motor to a position causing the desired character to be positioned into an intermediate position at the left of the printing point.

Thereafter, the DC motor will be operated again for a short time together with the elctromagnet or actuator up to the position of the daisy wheel on its desired position. The above mechanism may be also used for bi-directionally driving the rotating platen of an electronic typewriter.

What I claim is:

1. In an electronic typewriter comprising a platen; a carriage which is movable in front of said platen and on which is mounted a print device; an electric motor having a bidirectionally rotating rotor; motion converting means for converting the rotation of said rotor to motion of said carriage including a rotatable member permanently operating on said carriage for its movement wherein said electric motor is selectively actuatable for moving the carriage in two opposite directions in front of the platen; and setting means actuatable for arresting said rotatable member for a fine positioning of said carriage, the improvement comprising rectifying means for exactly arresting said carriage in front of a desired position of the platen, independently of the direction of movement of said carriage, said rectifying means comprising:

arrest means of said setting means capable of operating solely unidirectionally on said rotatable member;

first means defining an intermediate coarse position at a first side of said desired position along a given direction;

a control circuit which first actuates the electric motor for coarsely moving the carriage along one or another of the two opposite directions from a current position up to said intermediate coarse position then deactuates said electric motor once the intermediate coarse position has been reached; and second means for causing said control circuit to actuate again the electric motor and for actuating said setting means for unidirectional movement of the carriage from said coarse intermediate position to said desired position as defined by the unidirectional arrest of said rotatable member by actuated arresting means.

2. A typewriter according to claim 1, wherein said motion converting means further comprises friction means interposed between the rotor of said electric motor and said rotatable member to permit the rotation of said rotor when the rotatable member has been arrested by said actuated setting means.

3. An electronic typewriter according to claim 2, wherein said second means cause said control circuit to actuate said electric motor for a time longer than the time necessary to enable said carriage to reach said desired position.

4. A typewriter according to claim 1, further comprising a coarse transducer for the position of the carriage, wherein said transducer comprises a movable portion synchronous with said rotatable member and a detecting portion which produces a position signal in response to the movement of said movable portion and wherein the control circuit actuates said electric motor and said setting means under the control of said position signal.

5. A typewriter according to claim 4, wherein the movable portion of said transducer comprises a rotary ring having sectors which are magnetized alternately and the detecting portion of the transducer comprises detector means switchable under the action of the magnetic field of said sectors in a reference zone adjacent to the ring and wherein each field switching action is associated with a position of the carriage in front of a given region of another desired position of the platen.

6. A typewriter according to claim 4, wherein said motion converting means further comprises a pair of friction members interposed between the rotor of said electric motor and said rotatable member to permit further rotation of said rotor when the rotating member has been arrested by said actuated setting means, and wherein said friction members comprise a first portion permanently rotated by the rotor of said motor and a second portion permanently operating on the movable portion of the transducer.

7. A typewriter according to claim 6, wherein said motion convertiing means comprises a rotating wheel permanently operating on said carriage for its movement and provided with a peripheral tooth arrangement, wherein the setting means comprise a tooth engageable with the spaces of the peripheral tooth arrangement of the rotating wheel and wherein the movable portion of said tranducer is carried by one of said pair of friction members synchronous with said wheel.

8. A typewriter according to claim 7, wherein said tooth is actuated by a solenoid controlled by the said control circuit.

9. A typewriter according to claim 8, wherein said peripheral tooth arrangement has a sawtooth configuration.

10. A typewriter according to claim 1, wherein said rotating member is provided with a peripheral tooth arrangement, and wherein said setting means comprise a tooth engageable with the spaces of the peripheral tooth arrangement of the rotating member.

11. A typewriter according to claim 1, wherein said motor is mounted on said carriage and said motion converting means comprises an elongated member mounted parallel to the platen, and an intermediate member rotatably mounted on said carriage and operatively connecting the rotor of said motor with said elongated member for conversion of the rotation of said rotor into a translational movement of said carriage.

12. A typewriter according to claim 11, wherein said elongated member is a flexible wire and said intermediate member comprises a drum on which a portion of said flexible wire is wound.

13. An electronic typewriter comprising a rotatable selecting member defining a plurality of given positions;

an electric motor having a rotor and actuatable for bidirectionally rotating its rotor;

motion transmitting means for transmitting the rotation of said rotor to said selecting member including a pair of friction members interposed between said rotor and said selecting member to permit a free movement of said rotor also when said selecting member is held arrested;

a coarse transducer for said given positions of the selecting member having a rotatable portion synchronous with the selecting member and a detecting portion which produces a coarse position signal in response to each of the given positions of said selecting member;

means defining an intermediate coarse position at a first side of a desired given position along a given direction;

setting means actuatable for fine arresting of said selecting member; and circuit means responsive to said position signal for first actuating said electric motor for coarsely and selectively moving the selecting member in one of said two opposite directions from a current position to said intermediate and then deactuating said electric motor once the intermediate coarse position has been reached position; and wherein said circuit means reactivate said motor and actuate said setting means for unidirectional movement of said selecting member from said intermediate position to said desired position as defined by the arrest of said rotatable member by said actuated setting means.

14. An electronic typewriter according to claim 13, wherein said circuit means arrest again said motor during the unidirectional movement of said selecting member in response to a position signal associated with the desired position of said selecting member and after a time sufficient to the operation of said actuated setting means.

15. A typewriter according to claim 13, wherein said setting means comprise a tooth and a rotatable member, wherein said rotatable member is rotating in synchronism with the movement of the selecting member, and wherein said rotatable member is provided on its periphery with recesses of a sawtooth configuration, and further comprising an electromagnet connected with said tooth and actuatable by said circuit means for causing said tooth to engage one of said recesses to arrest said rotatable member.

16. A typewriter according to claim 13, wherein the movable portion of said coarse transducer comprises a rotary ring having sectors which are magnetised alternately and the detecting portion comprises a detector for the magnetic field of the sectors in a reference zone adjacent to the ring and wherein each field switching action is associated with the region of each one of said given positions of said selecting member.

17. An electronic typewriter comprising a platen;

a carriage which is movable in front of said platen and on which is mounted a print device;

an electric motor having a bidirectionally rotatable rotor;

motion converting means operated by said rotor for moving the carriage in two opposite directions in front of the platen, said motion converting means comprising a flexible wire extending substantially parallel to the platen, a drum member on which a portion of said wire is wound and friction means interposed between said rotor and said drum member;

setting means actuatable for precisely arresting the carriage in given positions in front of said platen, said setting means comprising a toothed wheel synchronous with said drum member and a positioning tooth actuatable for engaging and arresting said toothed wheel and wherein said friction means enable said rotor to rotate when the toothed wheel is arrested by said positioning tooth;

a coarse transducer for defining coarse positions of the carriage associated with said given positions, wherein said transducer comprises a movable portion which is synchronous with said toothed wheel and a detecting portion which produces a position signal responsive to the rotation of said movable portion and univocally associated with the coarse positions of said carriage;

means defining an intermediate coarse position at a side of a desired position of said given positions along a given direction;

a control circuit responsive to said position signal for first actuating said electric motor for coarsely moving the carriage in one or another of the two opposite directions from a current position up to said intermediate coarse position and then deactuating said electric motor once the intermediate coarse position has been reached; and means for causing said control means to actuate again said electric motor and for actuating said setting means for unidirectional movement of the carriage from said coarse intermediate position to said desired position as defined by the arrest of said toothed wheel by actuated positioning tooth.

18. An electronic typewriter according to claim 17, wherein said electric motor, said drum member and said setting means are mounted on said carriage.

19. An electronic typewriter according to claim 17, wherein said motion converting means comprise a rotating support fixing said drum member and said toothed wheel, wherein said rotor drives a pinion engaging with an intermediate gear rotatably supported by said rotating support and wherein said friction means comprises a first portion fixed to said rotating support and a second portion fixed to said intermediate gear.

20. An electronic typewriter according to claim 19, wherein said toothed wheel has a plurality of peripheral teeth having a sawtooth configuration, wherein each of said peripheral teeth has a steep surface and an inclined surface, and wherein the steep surface of one of said teeth is arrested against the actuated positioning tooth during the unidirectional movement of the carriage from the coarse intermediate position to said desired position.

* * * * *